United States Patent [19]

Kelley

[11] 3,994,494

[45] Nov. 30, 1976

[54] TETHERED BALL BASEBALL PRACTICE DEVICE

[76] Inventor: Burdette C. Kelley, 523 Third Ave. SE., Wells, Minn. 56097

[22] Filed: June 4, 1970

[21] Appl. No.: 43,416

[52] U.S. Cl. ..... 273/26 E

[51] Int. Cl.[2] ..... A63B 69/40

[58] Field of Search ..... 273/26, 95 A, 29, 58 (5), 273/26 E, 26 R, 29 R, 29 A, 58 C

[56] References Cited

UNITED STATES PATENTS

| | | | |
|---|---|---|---|
| 1,441,221 | 1/1923 | Fourcher | 273/26 E |
| 2,839,300 | 6/1958 | Blaha et al. | 273/26 E |
| 3,588,104 | 6/1971 | Griffin | 273/26 E |
| 3,593,998 | 7/1971 | Pattyn | 273/58 C X |

*Primary Examiner*—Richard C. Pinkham
*Assistant Examiner*—T. Brown

[57] ABSTRACT

A batting practice device for baseball batters having a support frame and a generally horizontally disposed laterally extended boom carried by the frame. A flexible cord has a portion thereof mounted to slidably extend along the boom and a portion which depends from the free end of the boom. A ball is connected to the free end of the depending portion of the cord and a motor is connected to the opposite end of the cord for imparting continuous reciprocal movement to the cord longitudinally thereof to vary the length of cord depending from the boom as the ball moves through an arcuate path of travel toward a batter.

7 Claims, 5 Drawing Figures

INVENTOR.
Burdette C. Kelley
BY
Merchant & Gould
ATTORNEYS

INVENTOR.
Burdette C. Kelley
BY
Merchant & Gould
ATTORNEYS

TETHERED BALL BASEBALL PRACTICE DEVICE

BACKGROUND OF THE INVENTION

1. Field of the Invention

The present invention relates generally to sports equipment and more specifically to a batting practice device for baseball batters. Over the years, it has been a problem of those teaching baseball to maintain a balance between the skills of participants pitching baseballs and those batting same. In recent years, baseball pitchers have tended to dominate the game of baseball since relatively little equipment is needed to develop such skills. Conversely, in order to develop the skill of a batter, one must provide a device which will present the ball to the batter over extended periods of time and in a manner to simulate the action of a ball normally thrown by a pitcher.

2. Description of the Prior Art

Many prior art devices for developing the batting skill of baseball batters have been provided, some of which are extremely complicated and expensive to produce and others which are relatively simple in construction. While the more complicated and expensive structures, some of which have the ability to simulate the various actions of a ball normally pitched by a pitcher, are acceptable to professional baseball teams, such devices are not normally available to organizations which teach youngsters the art of playing baseball due mainly to their great cost. Although the more simplified and inexpensive devices may be available for such instructions, such devices have not been heretofore satisfactory since they do not have the ability to simulate the various actions of a baseball pitched by a pitcher.

SUMMARY OF THE INVENTION

It is a primary object of the present invention to provide a batting practice device which is so constructed as to present a ball to a batter in a manner to simulate the action of a ball normally pitched by a pitcher.

It is another object of the present invention to provide a device of the class above-described which is simple in construction, durable in use, and extremely inexpensive to produce.

It is a still further object of the present invention to provide a device of the character above-described which is easily disassembled so as to be portable in nature.

With the above objects in mind, there is provided a supporting frame structure having a generally horizontally disposed laterally extended boom carried thereby. A flexible cord has a portion mounted to slidably extend along the boom and a portion depending from the free end of the boom has a ball connected to the free end thereof. Means are connected to the opposite end of the cord and affixed to one of the frame means and boom for imparting reciprocal movement to the cord longitudinally thereof to vary the length of cord depending from the boom as the ball moves in an arcuate path of travel and means carried by at least one of the frame means and boom limits the movement of the ball as it travels along the arcuate path of travel in a given direction.

BRIEF DESCRIPTION OF THE DRAWINGS

Referring to the drawings wherein like characters indicate like parts throughout the views.

DESCRIPTION OF THE PREFERRED EMBODIMENT

Figure 1:
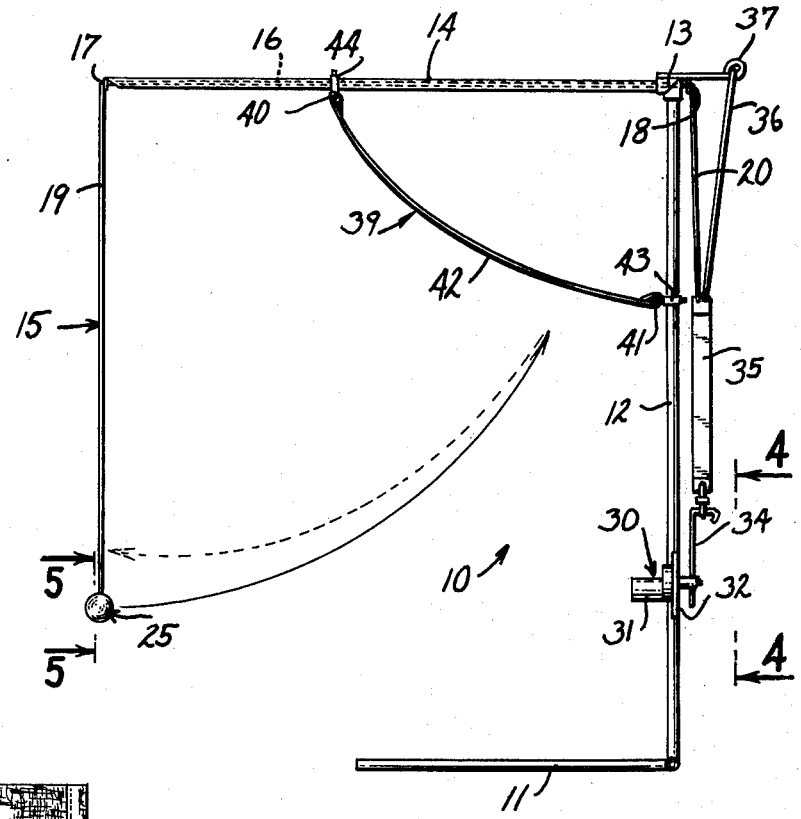
FIG. 1 is a view in side elevation of the batting practice device of the present invention.

Referring more particularly to the drawings, there is shown a batting practice device indicated generally by the numeral 10. Batting practice device 10 includes a support frame means having a base 11 and a vertically extended standard 12. Detachably secured to the upper end of the standard 12, by means of a threaded fitting 13, is a generally horizontally disposed laterally extended tubular boom 14. A flexible cord 15 has a portion 16 threaded through the tubular boom 14, fitting 13, and a pair of eyes 17, 18 positioned adjacent opposite ends of the tubular boom 14. A portion 19 of cord 15 depends from the eye 17 and a portion 20 thereof depends from the eye 18.

Figure 5:
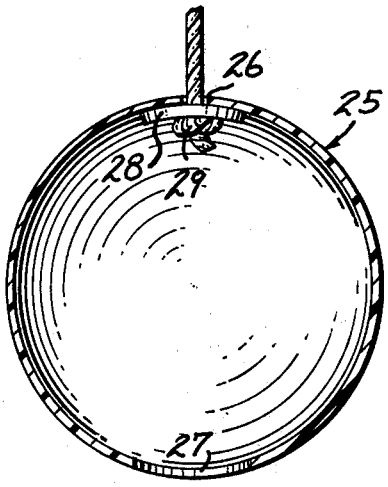
FIG. 5 is an enlarged vertical section as seen from the line 5—5 of FIG. 1.

A ball 25 is formed from a suitable plastic, such as polyurethane, into the shape of a hollow sphere. A pair of diametrically opposed openings 26, 27 are formed in the sidewall of the ball 25 with the latter thereof being of a considerably larger size for a reason which will become apparent immediately hereinafter. In order to securely affix the ball 25 to the depending portion 19 of cord 15, the free end of portion 19 is threaded through the opening 26 and thence through the opening 27 of ball 25. The free end of portion 19 is then threaded through an opening in a plastic washer 28 and thereafter tied so as to form an enlarged knot 29. Thereafter, the cord 15 with the washer 28 secured thereon is drawn through the opening 27 to the position shown in FIG. 5, thereby securely anchoring the ball 25 to the free end of depending portion 19 of cord 15.

Means for imparting reciprocal movement to the cord 15 longitudinally thereof, to vary the length of portion 19 of cord 15 depending from the boom 14, is indicated generally by the numeral 30. Means 30 includes an electrically operated motor 31 connected to a source of power, not shown, and fixedly mounted on a bracket plate 32 projecting laterally from the vertical standard 12. Motor 31 is in the nature of a gear head motor and includes a power output shaft on which is mounted a radially extending arm 34 for common rotation therewith.

Figure 3:
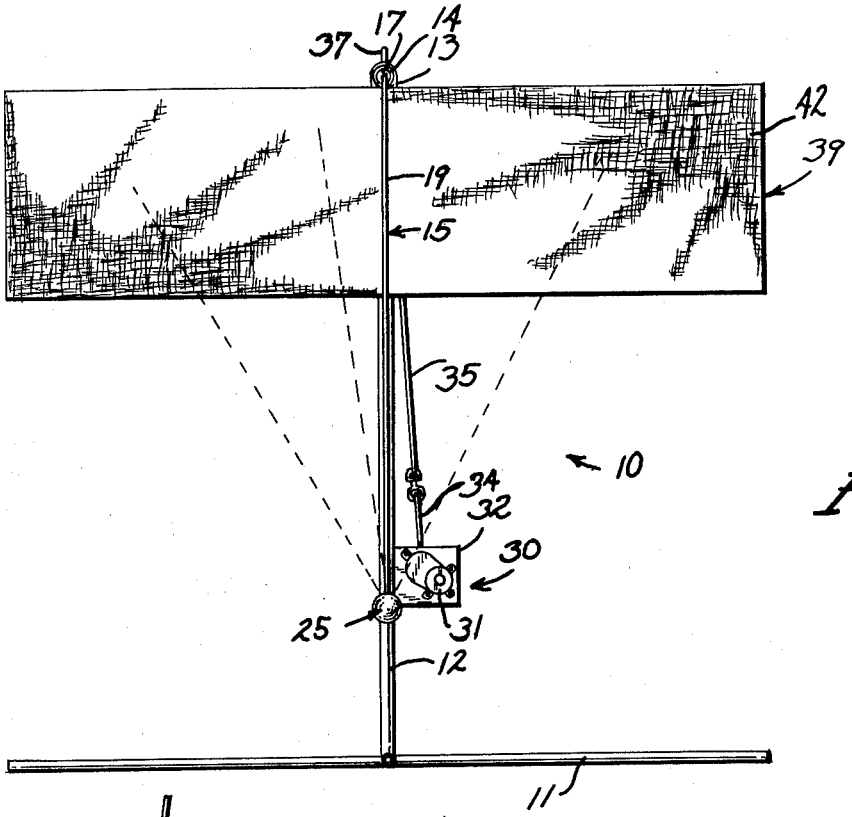
FIG. 3 is an elevational view as seen from left to right of FIG. 1.
Figure 4:
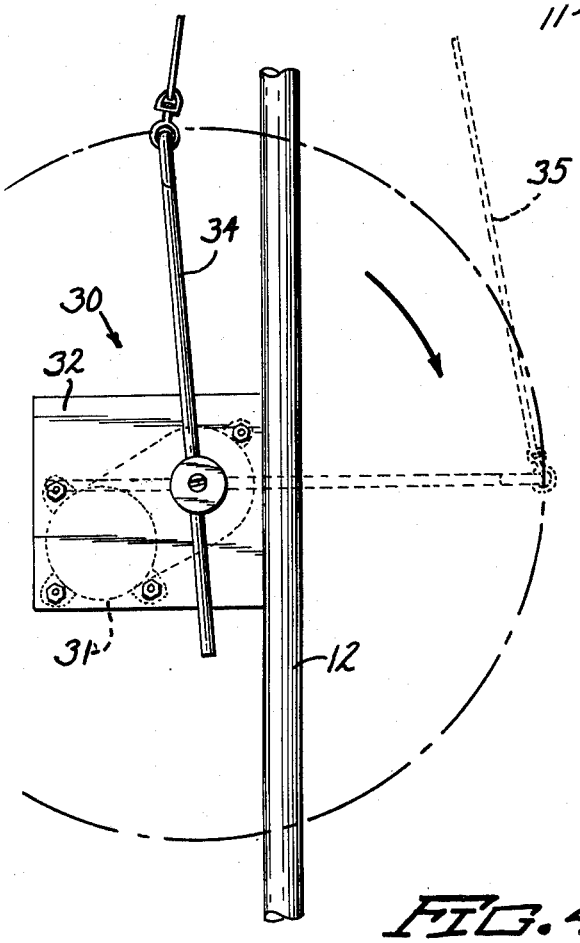
FIG. 4 is an enlarged detailed view in elevation as seen from the line 4—4 of FIG. 1.

A first stretchable resilient member 35, formed from rubber or the like, has one end thereof connected to the free end of the arm 34 and the other end thereof connected to the opposite free end of portion 20 of cord 15. In this manner, energization of the motor 31 causes the power output shaft thereof and the radially projecting arm 34 carried thereby to rotate in the direction indicated by the arrow of FIG. 4. By reference to FIGS. 1, 3 and 4, it will be seen that rotation of the power output shaft of motor 31 and radial arm 34 carried thereby through 180° of travel causes movement of the cord 15 in one direction longitudinally thereof so as to effectively shorten the length of portion 19 of cord 15. The remaining 180° of travel of arm 34 permits the ball 25 to return to the original position such as illustrated in FIG. 1. It will be appreciated that the combined weight of the ball 25 and portion 19 of cord 15, due to the construction of the ball 25, is not sufficient to overcome the combined weight of the portion 20 of cord 15 and the first stretchable member 35. To overcome this weight disadvantage, a second stretchable resilient member 36 has one end connected to the other end of the first stretchable resilient member 35 and an opposite end thereof connected to a bracket 37 carried by fitting 13. In this manner, the aforementioned differences in weight are compensated for, and the ball 25, portion 19 and 20 of cord 15 and first stretchable member 35 are returned to their full line positions of FIG. 1 during the remainging 180° of travel of the arm 34.

It will be here noted that the first stretchable member 35 requires a substantially greater force to stretch same than the second stretchable member 36 and is provided for the primary purpose of absorbing the shock of impact against the ball 25 caused by a batter striking same. Since the motor 31 is of a type having a low power output and constructed of parts which are relatively small in size, it has been found necessary to provide a shock absorber such as 35 to prevent damage to such motor 31.

Backstop means for limiting the movement of the ball 25 as it travels along an arcuate path of travel in a given direction, under the impetus of a batter striking same, is indicated generally by the numeral 39. Backstop 39 includes a pair of support elements 40, 41 having a generally rectangular, flexible, piece of sheet material 42 loosely suspended between same. Bracket means 43, 44 adjustably mounts one each one of the pair of support elements 40, 41 for adjustments longitudinally of the boom 14 and standard 12 respectively. Adjustment of such brackets 43, 44 position the piece of sheet material 42 in a manner to limit movement of the ball 25 when same is propelled in the direction of the full line arrow of FIG. 1 by a batter, not shown.

Figure 2:
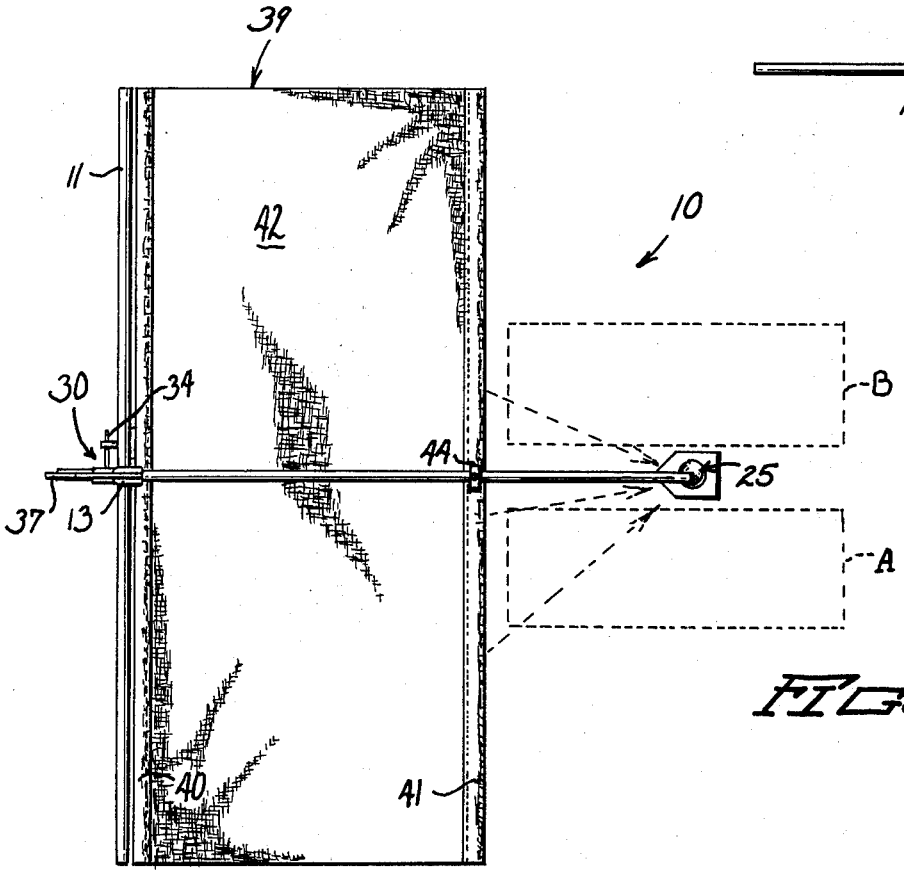
FIG. 2 is a view in top plan of the structure of FIG. 1 showing a right or left-handed batting area by dotted lines.

When a person wishes to utilize the batting practice device 10 to improve his batting skills, the motor 31 is energized and the batter takes up a position in one of the dotted line batting areas A or B, depending on whether he is right of left handed. Previous energization of the motor 31 imparts longitudinal or reciprocal movement to the cord 15 and ball 25. At this time the batter strikes the ball 25 with his bat, causing same to be propelled along an arcuate path of travel indicated by the full line arrow of FIG. 1, whereupon it strikes the backstop 39 and is caused to return in a direction indicated by the dotted line arrows of FIGS. 1 and 2. Assuming that the arm 34 is at this time moving from the full line position of FIG. 4 toward the dotted line position thereof, the ball 25 would be caused to return along an arcuate path of travel having a constantly shorter radius. Such action would simulate a ball normally thrown by a pitcher in a manner to rise to a higher level at point of impact. It will be appreciated that a great variety of positions of the ball 25 may be presented to the batter, depending upon the position of the arm 34 at the time the ball 25 travels along the arcuate path indicated by the dotted line of FIG. 1. For example, should the arm 34 be passing through a portion of its movement in the vicinity of 0° or 180° relative to FIG. 4, relatively little reciprocal movement will be imparted to cord 15 and ball 25 as the ball approaches the point of impact. Thus, during such periods, the ball 25 would simulate a pitch thrown in a generally straight line of flight at an ideal level. If the arm 34 is passing through a portion of its movement between 180° and 360°, relative to FIG. 4, ball 25 would approach the point of impact at a lower level or in the manner of a ball pitched to drop. In addition, the ball 25 may approach the batter from various angles, such as indicated by the dotted line arrows of FIG. 2. Such directions are determined by the direction in which the batter propels the ball 25 during a preceding swing of the bat. Such angular lateral return of the ball 25 in combination with the raising and lowering of same presents a very difficult target for a batter to hit. Over a prolonged period of use, it will be appreciated that a batter's coordination and eye will be greatly improved due to the wide variety of pitches simulated by the ball 25 as it approaches the batter standing in the box A or B from different lateral angles and different vertical levels.

In the case of extremely young boys attempting to learn the art of batting, it may be necessary to somewhat reduce the action of the ball 25. For this reason, arm 34 is mounted on a sleeve carried by the output shaft of motor 31 for adjustments longitudinally of the arm 34. That is, arm 34 may be shortened so as to reduce the reciprocal motion of the cord 15 and consequently the corresponding motion of the ball 25. As the younger batter develops his batting skills, the arm 34 may be again adjusted to lengthen same and increase the action of the ball 25.

What is claimed is:

1. A batting practice device for baseball batters comprising:

a. support frame means;

b. a generally horizontally disposed laterally extended cantilevered boom having one of its ends threadedly engaging said support frame means;

c. a flexible cord having a portion mounted to slidably extend along said boom, one of its ends freely depending from the free end of said boom and its other end connected to reciprocating means;

d. a hollow ball including means connecting same to said freely depending end of said cord; and e. said reciprocating means being affixed to said support frame means for imparting continuous reciprocal movement to said cord longitudinally of said boom to continuously vary the length of cord depending from said boom as said ball moves through an arcuate path of travel after being struck by a batter.

2. The structure of claim 1 in further combination with a backstop sheet of flexible material carried by said support frame means and boom to limit the movement of said ball as it travels along said arcuate path of travel in a given direction.

3. The structure of claim 1 in which said boom is tubular and in which said flexible cord is threaded through said boom longitudinally thereof.

4. A batting practice device for baseball batters comprising:

a. support frame means;

b. a generally horizontally disposed laterally extended cantilevered boom carried by said support frame means;

c. a flexible cord having a portion mounted to slidably extend along said boom having one of its ends freely depending from the free end of said boom and its other end attached to reciprocating means.

d. a ball including means connecting same to said freely depending end of said cord; and e. said reciprocating means being affixed to said support frame means for imparting continuous reciprocal movement to said cord longitudinally of said boom to continuously vary the length of said cord depending from said boom as the ball moves through an arcuate path of travel after being struck by a batter comprising:

i. an electrically operated motor fixedly mounted on said support means and having a rotary output shaft;

ii. an arm extending radially from said shaft and having one of its ends mounted thereon for common rotation therewith and its other end being free;

iii. a first stretchable resilient member having one end operatively connected to engage the free end of said arm and the other end thereof connected to said other end of said cord whereby rotation of said electrical motor imparts movement to said cord in at least one direction longitudinally thereof and said first stretchable resilient member absorbs the shock of impact against said ball caused by the batter striking same; and iv. a second stretchable resilient member having one end connected to said other end of said first stretchable resilient member and its other end thereof connected to said frame means whereby to impart movement of said cord in the opposite direction longitudinally thereof.

5. The structure of claim 4 in which said arm is mounted on said rotary output shaft for adjustment longitudinally of said arm to vary the amount of movement imparted longitudinally to said cord by said electrically operated motor.

6. The structure of claim 4 in which said first stretchable resilient member requires a substantially greater force to stretch same than said second stretchable resilient member.

7. A batting practice device for baseball batters comprising:

a. support frame means;

b. a generally horizontally disposed laterally extended cantilevered boom carried by said support frame means;

c. a flexible cord having a portion mounted to slidably extend along said boom, one of its ends freely depending from the free end of said boom and its other end attached to reciprocating means;

d. a ball including means connecting same to said freely depending end of said cord;

e. said reciprocating means being affixed to said support frame means for imparting continuous reciprocal movement to said cord longitudinally thereof to continuously vary the length of cord depending from said boom as the ball moves through an arcuate path of travel after being struck by a batter; and f. backstop means carried by said support frame means and boom to limit the movement of said ball as it travels along said arcuate path of travel in a given direction, including:

i. a pair of support elements extending transverse to the longitudinal axis of said boom;

ii. a generally rectangular, flexible piece of sheet material loosely suspended between said pair of support elements; and iii. bracket means adjustably mounting each of said pair of support elements one each to said support frame means and boom whereby movement of said ball in said given direction under the impetus of a batter striking same is limited by said piece of sheet material.

* * * * *